US006516617B1

(12) United States Patent
Schwieger

(10) Patent No.: US 6,516,617 B1
(45) Date of Patent: Feb. 11, 2003

(54) METHOD FOR TRANSFORMING HEAT USING A VORTEX AGGREGATE

(76) Inventor: Joachim Schwieger, Kullrichstrasse 18, D-1-44141 Dortmund (DE)

( * ) Notice: Subject to any disclaimer, the term of this patent is extended or adjusted under 35 U.S.C. 154(b) by 0 days.

(21) Appl. No.: 09/926,314

(22) PCT Filed: Apr. 13, 2000

(86) PCT No.: PCT/EP00/03301

§ 371 (c)(1),
(2), (4) Date: Jan. 25, 2000

(87) PCT Pub. No.: WO00/63534

PCT Pub. Date: Oct. 26, 2000

(51) Int. Cl.[7] ..... F01K 7/22
(52) U.S. Cl. ..... 60/679; 60/677; 60/653
(58) Field of Search ..... 60/653, 677, 679

(56) References Cited

U.S. PATENT DOCUMENTS

| | | | | |
|---|---|---|---|---|
| 3,090,208 A | * | 5/1963 | Munakata | |
| 3,788,064 A | | 1/1974 | Hawkins | |
| 4,037,414 A | * | 7/1977 | Nicodemus | 60/670 |
| 4,433,545 A | * | 2/1984 | Chang | 60/678 |
| 5,793,831 A | * | 8/1998 | Tsiklauri et al. | 379/317 |

FOREIGN PATENT DOCUMENTS

| | | |
|---|---|---|
| DE | 3825155 | 12/1988 |
| DE | 4343088 | 6/1995 |
| DE | 29512149 | 1/1997 |

OTHER PUBLICATIONS

An English Language abstract of DE 43 43 088.

An English Language abstract of DE 38 25 155.

"Woher nehmem Tornados ihre Energie?" *Implosion*, Issue 30, pp. 11–20 (1968).

Hilsch, "Die Expansion von Gasen im Zentrifugalfeld als Kälteprozeβ," *Zeitschrift für Naturforschung*, pp. 208–214 (1946).

* cited by examiner

*Primary Examiner*—Hoang Nguyen
(74) *Attorney, Agent, or Firm*—Greenblum & Bernstein, P.L.C.

(57) ABSTRACT

The aim of the invention is to reduce exhaust steam losses and thus efficiency losses in condensation power stations such that the steam does not expand to the attainable vacuum (as is the case in the prior art) but, after extraction from a turbine or the like, is elevated in the caloric content thereof to a higher pressure stage in a heat transformer by means of pumps, which are connected upstream therefrom and which are provided for the secondary circuit, in order to effect a renewed expansion at said heat transformer. This is repeated as often as possible until the quantity of heat which otherwise escapes through the cooling tower is largely converted into electric energy.

10 Claims, 2 Drawing Sheets

METHOD FOR TRANSFORMING HEAT USING A VORTEX AGGREGATE

CROSS-REFERENCE TO RELATED APPLICATIONS

The present application is a U.S. National Stage Application PCT/EP00/03301 filed Apr. 13, 2000, and claims priority under 35 U.S.C. §119 of German Patent Application No. 199 16 684.6 filed Apr. 14, 1999.

BACKGROUND OF THE INVENTION

1. Field of the Invention

The invention relates to a method of heat transformation by means of a vortex unit, in which a steam flow and in particular a saturated steam flow is divided in the vortex unit into a heated partial flow and into a cooled partial flow and condensation takes place in the cooled partial flow.

2. Discussion of Background Information

German laid-open application (DE-OS) No 43 43 088 discloses a condensation-type vortex tube which serves for drying, separating and superheating saturated or wet steam. That vortex tube is characterised by the following features:

a) the saturated steam or wet steam is introduced by way of an intake nozzle tangentially to the cross-section of a vortex tube portion, forming a swirl flow, partially condensed there, and separates under the effect of the force of gravity into a hot flow which flows away upwardly and which comprises superheated dry steam and a cold flow which flows away downwardly through a tapering funnel-like tube, the cold flow comprising condensate and cold steam; and b) the cold steam is passed through a rib-type cooling tube, collected in a condensated collecting container therebeneath and discharged by way of a condensate discharge.

The article '*Woher nehmen Tornados ihre Energie*?', the journal 'Implosion' issue 30, 1968, pages 11 to 20, explains the relationships and conditions involved in the case of cyclones and tornadoes in such a way that in cyclones or tornadoes the flowing medium circles at an increasing angular speed in ever tighter turns around a so-called suction funnel and in so doing rolls in, in which case the vapor-air mixture is so-to-speak wrung out, the humidity in the air condenses and precipitates in the form of rain. In that situation the heat of condensation which is liberated is in part converted into kinetic and electrical energy and urged outwardly from the center where it precedes the tornado for example in the form of a wave of heat. That heat can be used in order to evaporate the condensate, after a rise in pressure, at a higher temperature level, in order to achieve working gradients.

SUMMARY OF THE INVENTION

The present invention reduces exhaust steam losses and thus losses in respect of efficiency, in particular in the case of condensation power plants. The present invention also improves the utilization of heat in relation to district heating heat production, desalination installations, the production of water or the like.

Based on the heat transformation described in the opening part of this specification by means of a vortex unit in accordance with the invention, the condensate, after an increase in pressure by a pump, absorbs the heat of the heated partial flow and evaporates, and the steam, after work is done in a turbine, is recycled to the vortex flow.

The article 'Die Expansion von Gasen im Zentrifugalfeld als Kälteprozess' by Rudolf Hilsch in the Zeitschrift für Naturforschung 1946, pages 208–214, describes the structure and the mode of operation of a vortex tube operated with air. If the vortex tube is charged with vapor, in particular steam, then condensation of the cold partial flow is to be expected, in which case the increase in pressure of the condensate by means of a pump is much more energy-advantageous than the increase in the air pressure in the vortex tube by means of compressors. The pressure drop can now also be made economical by virtue of saturated steam production. In that case the heat of the hot flow component of the edge zone is transmitted to the condensate of the core flow whose evaporation temperature is set by means of the saturated steam pressure to the highest possible level in order to achieve a maximum pressure drop which is worked off in a turbine to the intake pressure of the vortex tube. There, the process can begin afresh. In that case the condensate is passed on the outside around the heated edge zone of the vortex tube, absorbs the heat thereof and evaporates.

Other vortex units and so-called rolling-in units are known from a number of Schauberger patents. These are predominantly intended for gaseous media or water without a change in the state of aggregation of the medium. The use of steam, preferably saturated steam, leads to the expectation of a much greater change in volume due to condensation and a higher level of conversion of heat than when using compressed air. A higher temperature rise will occur and it is of advantage in regard to the level of the attainable saturated steam pressure on the secondary side.

The steam intake is effected approximately tangentially into a vessel which tapers downwardly and whose shape corresponds to an egg or a funnel. The condensate is carried away downwardly. The speed of rotary movement with which the steam flow, advancing in spiral vortices, passes through the longitudinal axis of the rolling-in unit, is of major influence. In order to achieve the optimum effect of separation into a core flow with condensation and into an external flow with the highest possible temperature rise, it is necessary to try out the effect of a slight inclined positioning of the tangential intake tube, as well as the magnitude of the intake speed with or without nozzle.

The apparatus dimensions are to be designed for relatively large amounts of steam. It can be ascertained by means of tests whether in basic use the Schauberger unit with the same flow direction for hot and cold partial flows or the vortex tube principle with opposite directions in respect of the discharge flow of the core zone and the edge zone exhibits the better effect.

If the basic starting point adopted is existing condensation power plants, preferably wet steam is to be used therefrom, from the vacuum area, for example 0.2 bar (ts~60° C.) at about 0.7 bar (ts~39° C.) condensation pressure. That gives a pressure ratio of almost 3 for relief in the rolling-in unit. The aim here is a maximum level of topping power of the existing turbine whose power would only be limited in the vacuum area.

The following turbine procedure is to be designed in accordance with the respectively attainable secondary steam pressure of about 15 bars (ts~198° C.) or higher, for example 60 bars (ts~275° C.). If the secondary steam were to convert 20% of the transformed heat of condensation transmitted thereto, then about 5 through-passages would be required in order to convert that heat transmitted in that situation completely into electrical energy.

This simplified representation takes no account of the fact that, when the steam flow is divided up, in terms of the proportions involved, only the path of the cold flow is involved, by way of condensate and secondary steam. In the case of the vortex tube however consideration is to be given to the ratio of the cold flow to the total flow. Which division results in the optimum temperature increase is to be ascertained experimentally.

The vortex tube measurements exhibit a residual increased pressure at the hot end of the tube, whereas relief of the cold air component is to atmospheric pressure. The remaining temperature of the hot flow is substantially dependent on the extent to which that hot flow is cooled down in production of the secondary steam. Conduction of the heat is effected continuously by way of the hot flow.

In regard to the further path of the hot flow component, simply working off the pressure drop which is obtained at the dynamic pressure pi will be of less use. Therefore it is repetition of the described process in the vortex unit that presents itself. It will be appreciated that for that purpose the pressure of the first through-passage must be raised from about 0.2 bar to about 0.6 bar so that for a second subsequent through-passage there still remains a sufficient pressure drop with which the hot flow component which is relieved from 0.6 bar to 0. 2 bar—in addition to dynamic pressure—can continue to be relieved to 0.07 bar.

If in both cases a division factor of 0.5 is assumed to apply, then after division twice after the second passage 25% remains as the hot flow component, in relation to the initial intake steam flow. That 25% would have to be worked off with the slight residual drop of the dynamic pressure pi and would have to be deposited in the condenser, that reduced amount of steam permitting a lower condenser pressure. Alternatively that amount of exhaust steam can be used for heating purposes, in which case the residual drop is used once again in a vortex tube for a moderate rise in temperature.

The aim, in the respective vortex stages, is to obtain the same secondary steam pressure of for example between 15 and 60 bars, in order to bring those steam flows together and possibly at a suitable pressure stage to be able to forward them jointly with the intake steam flow, for the purposes of simplifying the procedure. The steam flows of the various pressure stages after heat transformation are to be matched to each other.

In the case of the method according to the invention, the vortex unit used can be a rolling-in unit which operates in counter-flow relationship or a unit involving the same direction of flow of the edge and core flows.

The method according to the invention can also be used for district heating heat production. It is also possible to generate steam from waste heat, solar heat and the like, which is then at least partly transformed to a higher temperature stage, for conversion into power or heat. A heat pump can also be used in respect of non-busy tariff power.

The method according to the invention is suitable for sewage purification or sea water desalination because in the various evaporation stages the pure condensate produced there can be removed for it to be used and can be replaced by water to be purified, of which then a residual amount with concentrated impurities or salt water is to be decanted.

In order to obtain water in hot dry areas the method affords the possibility that, depending on the respective relative humidity of the air which is cooled down overnight, the cold air flow can be cooled by air compression with subsequent relief in the vortex tube to below the dew point so that water condenses out. A part of that water in the day time can then be evaporated by means of solar heat by way of focusing mirrors, in which case the water pressure produced by way of a pump is to be matched to the saturated steam temperature which can be attained. The energy obtained from the secondary steam by means of a turbine is then stored on a battery and used for nighttime operation of the air compressor. In that way the hot air flow can possibly be used at night to produce steam and power.

As the Carnot efficiency in the case of the method according to the invention no longer represents a limitation in terms of the efficiency of conversion into electrical energy—in view of the procedure being divided into a plurality of individual procedures each with their own fresh steam state after heat transformation—, it is possible to produce current economically even with heat sources involving relatively low temperature levels. In the case of new power stations, the compulsion for high fresh steam parameters can disappear. The level of operating reliability and availability can increase and the power output is less dependent on cost digression.

In order to illustrate heat transfer in a vortex tube attention is directed to the article by R Hilsch (Z. Naturforschg. 1, 208–214).

In operation with compressed air at $\gamma$=0.5 cold air component in respect of the total flow a temperature spread of about 90° C. (between +60° C. and −30° C.) can be measured. The cold air flow can be heated by heat transfer by 70° C. to +40° C., with the hot air component cooling from +60° C. to −10° C. However, even at −30° C. the cold flow component requires too much compression energy and as a result experiences an excessively high heating effect, which prevents the above-mentioned transfer of heat and useful work.

These circumstances are changed when charging the vortex tube with steam because the cold flow component involved is condensate which is to be heated after a rise in pressure by the hot flow. What is essential in that respect is that the secondary saturated steam temperature is above the saturated steam temperature of the primary hot flow component. Heat transfer is effected by the heated primary hot steam phase.

The present invention is directed to a process of heat transformation tat includes dividing a steam flow in a vortex unit into at least a heated partial flow and a cooled partial flow, whereby condensation occurs in the cooled partial flow to form a condensate. The process also includes increasing pressure on the condensate to absorb heat of the heated partial flow, whereby the condensate evaporates to form steam, and recycling the steam to the vortex unit.

In accordance with a feature of the invention, the steam flow includes a saturated steam flow.

According to another feature of the present invention, the process further includes using the steam to work in a working machine. Further, the steam is not recycled until after the work in the working machine is complete.

In accordance wit still another feature of the present invention, the pressure on the condensate is increased by a pump.

Moreover, the vortex unit includes a vortex tube having an edge zone and a core zone, in which heating of the steam-flow is effected in the edge zone, and cooling and condensation is effected in the core zone, and the process further includes guiding the condensate, after the increase in pressure, to flow around an outside of the vortex tube.

According to the invention, transformed heat of condensation is fed stepwise to turbines in a plurality of through-passages.

Further, the hot partial flow heats an evaporator, and the process further includes feeding the condensate, after the increase in pressure, the evaporator, in which the condensation evaporates.

In accordance with the instant invention, additional vortex units are coupled together in series with the vortex unit, in which each of vortex unit and the additional vortex units include an evaporator, and said process further includes guiding a remainder of the heat absorbed hot partial flow to a lower-pressure stage formed at least in part by an adjacent downstream vortex unit, and dividing the heat absorbed hot partial flow in the adjacent downstream vortex unit into a cold flow component and a hot flow component, wherein condensation occurs in the second condensate to form a second condensate. The process also includes increasing the pressure on the second condensate to absorb heat from the hot flow component, whereby the second condensate is evaporated. Further, a last vortex unit includes a vortex tube, and the process further includes depositing a last hot flow component of the last vortex tube stage as an amount of exhaust steam in a condenser.

DETAILED DESCRIPTION OF THE PRESENT INVENTION

In the drawings

| | |
|---|---|
| A = old installation | m = [kg/s] relative |
| N = new installation | 1 m = 100% live steam |
| G = generator | p = [bar] [kJ/kg] pressure |
| T = turbine | pi = dynamic pressure |
| W = vortex unit | t = [° C.] temperature |
| P = pump | h = [kJ/kg] enthalpy |
| V = evaporator | |

Figure 1:
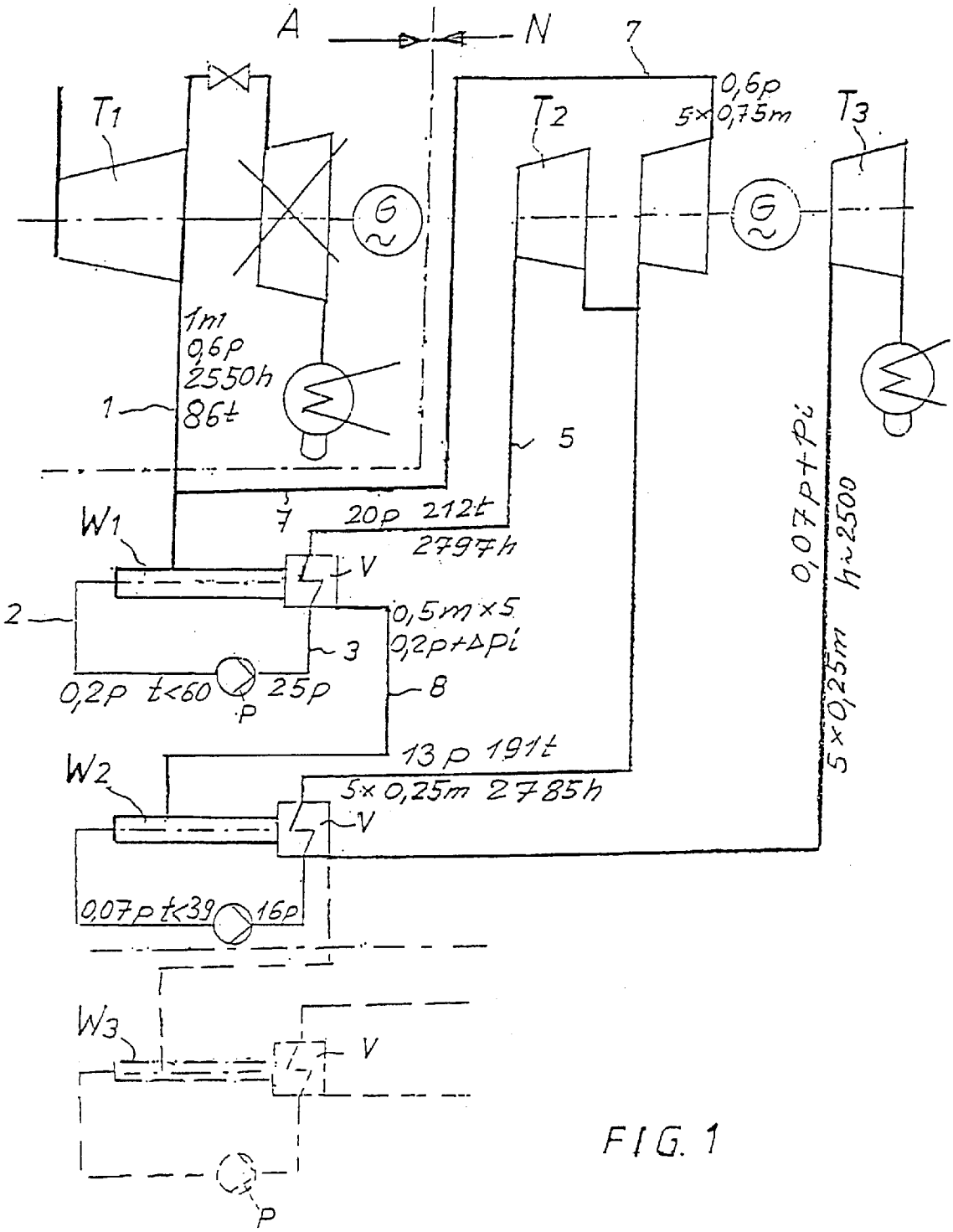
FIGS. 1 and 2 of the drawing show diagrammatic views illustrating the principle of condensation power plants which operate with the method in accordance with the invention and in which different operating parameters are entered.

In the case of the condensation power plant shown in FIG. 1 steam flows out of a turbine $T_1$ of an existing old installation A by way of a line 1 to a vortex unit $W_1$ and is divided into two partial flows at different temperatures. The colder partial flow condenses and the condensate is fed by way of a line 2 to a pump 3 for an increase in pressure. Then the condensate in the evaporator V absorbs the heat of the hot flow and evaporates. The steam flows by way of a line 5 to a turbine $T_2$. After work is done the steam is returned by way of a line 7 into the vortex flow to the line 1. The hot flow component of the vortex unit $W_1$, which is already cooled in the evaporator V, is fed by way of a line 8 to the next transformation stage $W_2$. It is possible to provide one or more farther vortex unit stages n in which division into two partial flows is repeated.

The condensation losses can be reduced by the following measures:

1. Lower pressure loss for the individual vortex tube stages. Each of those stages can comprise a number of parallel-connected vortex tubes $W_1$, $W_2$ and $W_3$.
2. The increase in the number of stages to 4 or more. With n stages the amount of condensation steam $G_K$ is about 0.07 bar, that is to say the hot flow component from the last VT-stage, $G_K=(1-\gamma)^n$, in relation to the amount of circulating steam of the new installation in continuous operation.
3. Reduction in the hot flow component $(1-\gamma)$ in relation to the total flow, for example from 50% to 33%.

Figure 2:
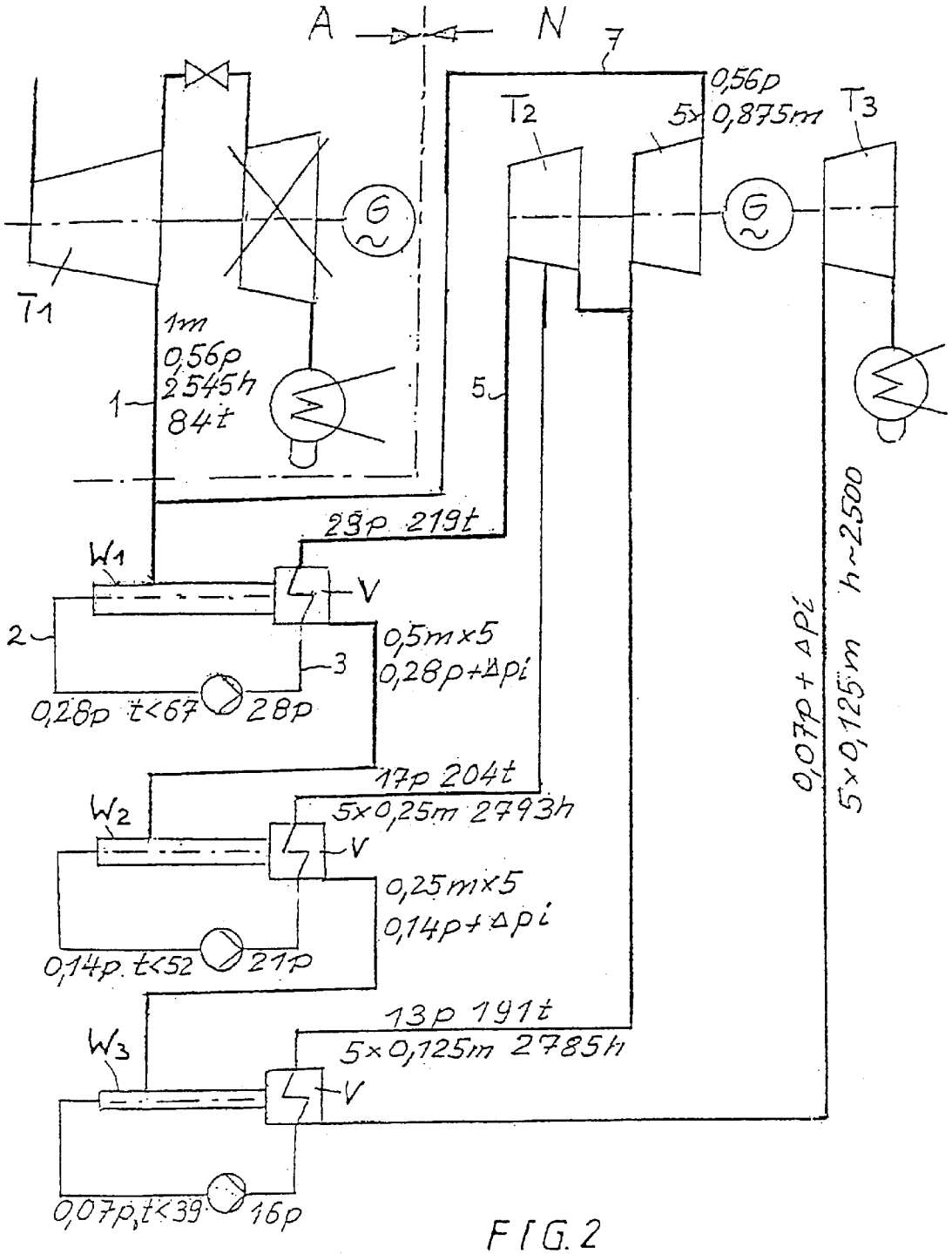

Amended values in FIG. 2 are compared to the values of the installation shown in FIG. 1, in which respect the percentages relate to the amount of live steam from the old installation A which would flow into the condenser if not removed.

The following are assumed to apply as intake pressures (in bars) for the individual vortex unit stages $W_1$ through $W_3$:

| | n | $W_1$ | $W_2$ | $W_3$ | Condenser |
|---|---|---|---|---|---|
| Figure 1 | 2 | p = 0.6 | 0.2 | — | ~0.07 |
| Figure 2 | 3 | p = 0.56 | 0.28 | 0.14 | ~0.07 |
| | 3 | p = 0.33 | 0.2 | 0.12 | ~0.07 |

In the last case with p=0.33 bar for $W_1$ a dynamic pressure pi for the hot flow component of about a third of the pressure ratio present in compressed air is taken into consideration, in the vortex tube, wherein the pressure ratio is about $1+(1-\frac{1}{3})=1.67$.

For a fourth vortex tube stage there would be an intake pressure of 1.67×0.33 =0.55 bar. The hot flow component is reduced from 50% to 33%. The condensation flow, with a hot flow component of $1-\gamma$ and n vortex stages, is:

$$G_K=(1-\gamma)^n.$$

With a drop in respect of the secondary steam amount of 20% of the amount of heat transmitted in the heat transformer the amount of circulating steam and thus the amount of condensation steam $G_K$ would increase to 5 times the amount of live steam of 1 m.

n

FIG. 1 2 $G_k, A_2=(1-0.5)^2=\frac{1}{4}\times5=125\%$

3 $G_k$, $A_3=(1-0.5)^3=\frac{1}{8}\times5=63\%$

FIG. 2 3 $G_k$, $B_3=(1-0.67)^3=\frac{1}{27}\times5=19\%$

4 $G_k$, $Bj_4=(1-0.67)^4=\frac{1}{81}\times5=6\%$

These examples show the wide range of fluctuation in the amount of condensation steam (here between 125% and 6%), which has a crucial influence on the level of efficiency. In this respect the exhaust steam enthalpy which is presumably higher in relation to the old installation will be less significant.

The speed of rotation in the vortex unit can produce a suction component. Accordingly such a suction component could have a supporting effect and reduce the pressure loss in the vortex unit. As a result a larger number of vortex unit stages can be connected in series. That will reduce the amount of exhaust steam to be deposited in the condenser and thus decrease the residual lost heat to be removed.

If the vortex units were to be adopted to approximately implement a saturated steam pressure which is suitable for a turbine medium pressure housing, of about 60 bars in regard to design and correspondingly lower in relation to partial load in the variable-pressure mode of operation, then that part of the turbine can also be incorporated for re-use. The turbine stages of the 'old installation' downstream of the removal pressure for the uppermost vortex stage $W_1$ of for example 0.6 bar are to be removed upon conversion to the new installation.

What is claimed is:

1. A process of heat transformation comprising:

dividing a steam flow in a vortex unit into at least a heated partial flow and a cooled partial flow, whereby condensation occurs in the cooled partial flow to form a condensate;

increasing pressure on the condensate to absorb heat of the heated partial flow, whereby the condensate evaporates to form steam; and recycling the steam to the vortex unit.

2. The process in accordance with claim 1, wherein the steam flow comprises a saturated steam flow.

3. The process in accordance with claim 1, further comprising using the steam to work in a working machine.

4. The process in accordance with claim 3, wherein the steam is not recycled until after the work in the working machine is complete.

5. The process in accordance with claim 1, wherein the pressure on the condensate is increased by a pump.

6. The process in accordance with claim 1, wherein the vortex unit comprises a vortex tube having an edge zone and a core zone, in which heating of the steam flow is effected in the edge zone, and cooling and condensation is effected in the core zone, and said process further comprising.

guiding the condensate, after the increase in pressure, to flow around an outside of the vortex tube.

7. The process in accordance with claim 1, wherein transformed heat of condensation is fed stepwise to turbines in a plurality of through-passages.

8. The process in accordance with claim 1, wherein the hot partial flow heats an evaporator, and said process further comprising:

feeding the condensate, after the increase in pressure, the evaporator, in which the condensation evaporates.

9. The process in accordance with claim 1, wherein additional vortex units are coupled together in series with the vortex unit, in which each of vortex unit and the additional vortex units include an evaporator, and said process further comprises:

guiding a remainder of the heat absorbed hot partial flow to a lower-pressure stage formed at least in part by an adjacent downstream vortex unit;

dividing the heat absorbed hot partial flow in the adjacent downstream vortex unit into a cold flow component and a hot flow component, wherein condensation occurs in the second condensate to form a second condensate;

increasing the pressure on the second condensate to absorb heat from the hot flow component, whereby the second condensate is evaporated.

10. The process in accordance with claim 9, wherein a last vortex unit comprises a vortex tube, and said process farther comprises:

depositing a last hot flow component of the last vortex tube stage as an amount of exhaust steam in a condenser.

* * * * *